United States Patent [19]

McGrath

[11] Patent Number: 5,014,450

[45] Date of Patent: May 14, 1991

[54] SNOWSHOE

[76] Inventor: James J. McGrath, P.O. Box 362, Great River, N.Y. 11739

[21] Appl. No.: 396,084

[22] Filed: Aug. 21, 1989

[51] Int. Cl.[5] ..... A43B 5/04; A63C 1/02

[52] U.S. Cl. ..... 36/124; 36/122; 280/11.3

[58] Field of Search ..... 36/122, 123, 124, 125; 280/11.3, 611

[56] References Cited

U.S. PATENT DOCUMENTS

| | | | |
|---|---|---|---|
| D. 161,198 | 12/1950 | Paden | 36/122 X |
| D. 163,316 | 5/1951 | Paden | 36/122 X |
| 1,004,900 | 10/1911 | Pease | 36/124 |
| 2,515,070 | 7/1950 | Anderson | 36/122 |
| 2,615,260 | 10/1952 | Paden | 36/122 |
| 3,269,037 | 8/1966 | Massicatte | 36/124 |
| 3,299,541 | 1/1967 | Snyder | 36/125 |
| 3,638,333 | 2/1972 | Sprandel | 36/125 |
| 3,673,713 | 7/1972 | Fedewitz | 36/125 |
| 3,802,100 | 4/1974 | Prater | 36/124 |
| 3,992,790 | 11/1976 | Frye | 36/125 |
| 4,045,889 | 9/1977 | Woolworth | 36/122 |
| 4,085,529 | 4/1978 | Merrifield | 36/125 |
| 4,259,793 | 4/1981 | Morgan, Jr. et al. | 36/125 |
| 4,720,928 | 1/1988 | Faber et al. | 36/127 |

FOREIGN PATENT DOCUMENTS

| | | | |
|---|---|---|---|
| 2409066 | 7/1979 | France | 36/124 |

*Primary Examiner*—Steven N. Meyers
*Assistant Examiner*—Ted Kavanaugh
*Attorney, Agent, or Firm*—Leonard Belkin

[57] ABSTRACT

A snowshoe constructed of a solid piece of rigid material having a cross brace for pivotally supporting a binding for the boot of the wearer. An opening forward of the cross brace permits the toe of the boot to pivot downwardly. The snowshoe is provided with braces of L-shaped construction and openings to reduce weight. Studs may be employed for traction on hardpacked snow and ice. The solid piece making up the platform of the shoe is made from a light weight rigid plastic material such as polypropylene.

1 Claim, 4 Drawing Sheets

SNOWSHOE

BACKGROUND OF THE INVENTION

The present invention relates to a snowshoe and more particularly to a snowshoe which is light in weight and more effective and useful than existing snowshoes, while at the same time reducing the cost to the consumer.

A snowshoe is a device that is fastened to the bottom of a boot to facilitate traversing deep snow with minimal sinking into the snow. The binding is the device which holds the snowshoe to the boot of the snowshoer.

There are a large variety of snowshoes on the market. One problem with existing designs has to do with their weight. A heavy snowshoe makes it difficult for the wearer to do any extensive walking on snow consequently having a negative impact on endurance, thereby discouraging the use of snowshoes as a sport. Another problem with existing shoes has to do with the bindings. Most bindings attach the bottom of the boot to the shoe in such a way as to limit the freedom of motion of the foot and this adds to the discomfort and diminishes the utility of using the snowshoe.

Other drawbacks of existing designs involve shapes which make walking more difficult, size of the shoes which makes it difficult to move the legs, and cost which makes some showshoes too costly for a mass market.

A variety of showshoe designs are shown in the following U.S. Pat. Nos.: Des. 161,198, 1,004,900, 2,515,070, 2,615,260, 3,299,541, 3,802,100, 4,045,889, 4,085,529, and 4,720,938. These patents show a variety of configurations. None of the preceding patents teaches the present invention including the specific manner of utilizing bindings in the present application.

SUMMARY OF THE INVENTION

In the present invention, many of the problems associated with current snowshoe designs are eliminated or reduced by providing a snowshoe which is lighter than shoes currently made, provides more comfort and ease of use than was previously thought to be possible, and at the same time in a shoe of significantly less cost to the consumer.

Other benefits of this invention are increased efficiency coupled with greater durability and low maintenance requirements.

In a preferred embodiment of this invention, the snowshoe consists of a molded piece of a rigid plastic such as polypropylene structured to provide great strength at a very light weight, employing a binding which hinges at the ball of the foot to permit the heel to be raised while at the same time minimizing lateral or side to side motion of the heel. The plastic composite is tough, chemically stable, and sheds snow without any surface treatment. In addition, a restraint is built into the bindings to limit rotation of the snowshoe to avoid having the toe of the shoe impact the shin of the wearer.

It is thus a principal object of this invention to provide a snowshoe with improved usefulness at a reduced cost to the consumer.

Other objects and advantages of this invention will hereinafter become obvious from the following description of preferred embodiments of this invention.

DETAILED DESCRIPTION OF THE PREFERRED EMBODIMENTS

Figure 1:
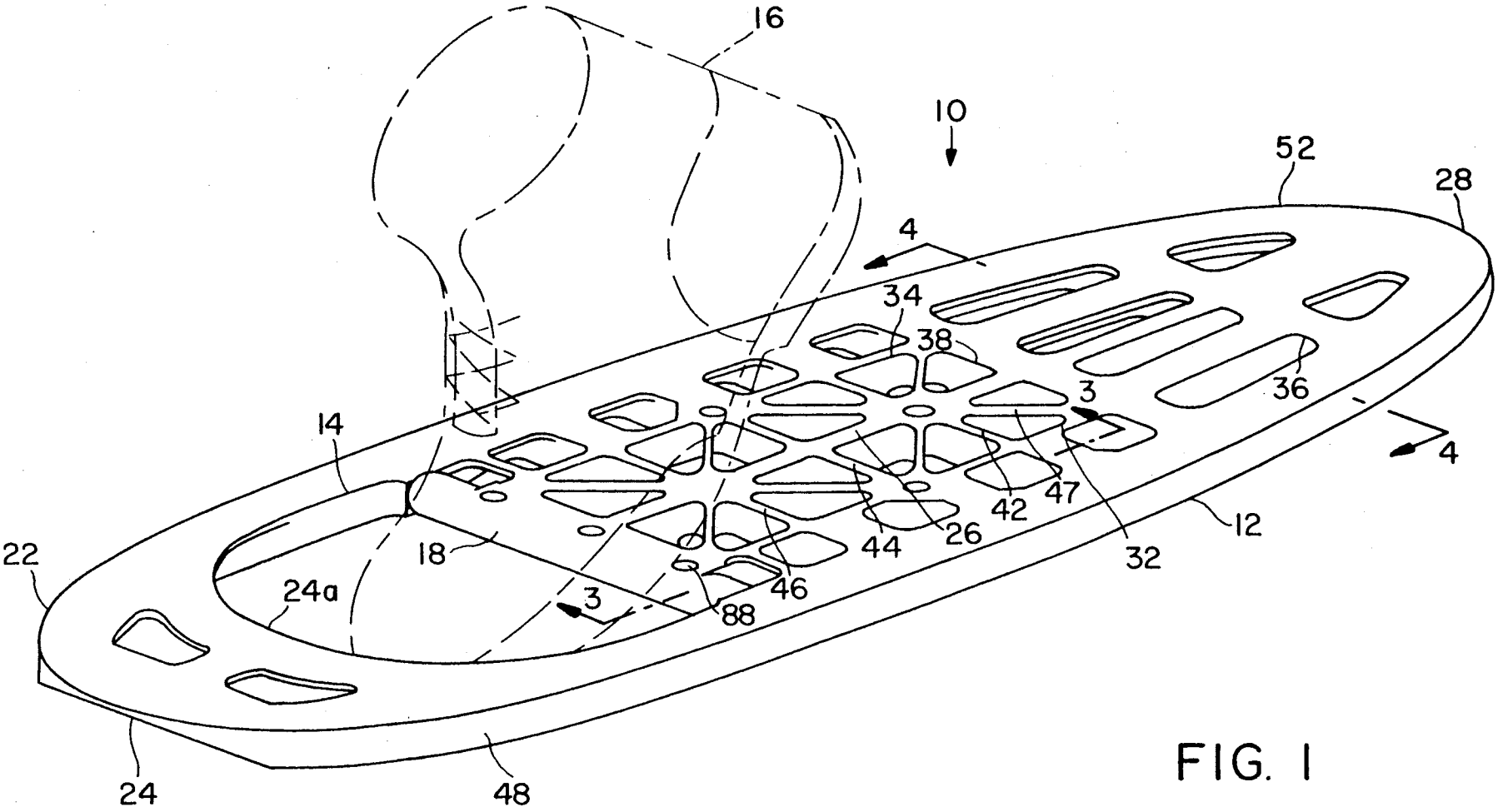
FIG. 1 is an isometric view of a preferred embodiment of this invention with the binding removed.

Referring to FIGS. 1–4, snowshoe 10 consists of a molded platform 12 made from a single piece of rigid plastic such as polypropylene having an opening 14 to permit the toe of boot 16 to pivot down as illustrated. The rear of opening 14 is bounded for a purpose to be described below by a main cross brace 18, whose forward facing surface is circular in cross section to permit rotation of the binding as will be explained below.

Platform 12 is elliptical front and rear to allow easy streamline passage through the snow, and is flat to allow for the creation of steps in the snow while climbing uphill. The flat shoe, which includes a flat outer surface to be described below, also minimizes backsliding when going up slopes. To prevent digging in, toe 22 is provided with chamfer 24 on the underside.

To the rear of main cross brace 18 is provided a long rib 26 extending from brace 18 to the heel 28 along the central axis of platform 12. A pair of intermediate ribs 32 and 34 extend from main cross brace 18 to lateral or cross rib 36 parallel to long rib 26, producing excellent bending strength.

A plurality of lateral ribs 36, 38, 42, 44, and 46 provide lateral strength to the shoe.

Figure 4:
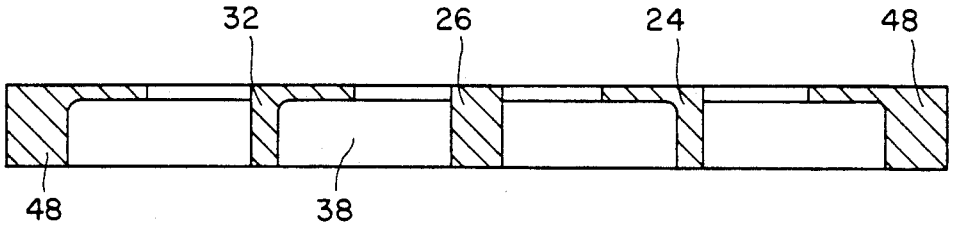
FIG. 4 is a section taken along 4—4 of FIG. 1.

As seen in FIG. 4, the L-shaped cross section of intermediate ribs 32 and 34, which is actually a rectangle with a lip, adds considerable strength with reduced weight. Diagonally directed ribs 47 may also be employed to provide improved rigidity. Outer edge 48 is similarly constructed.

Figure 2:
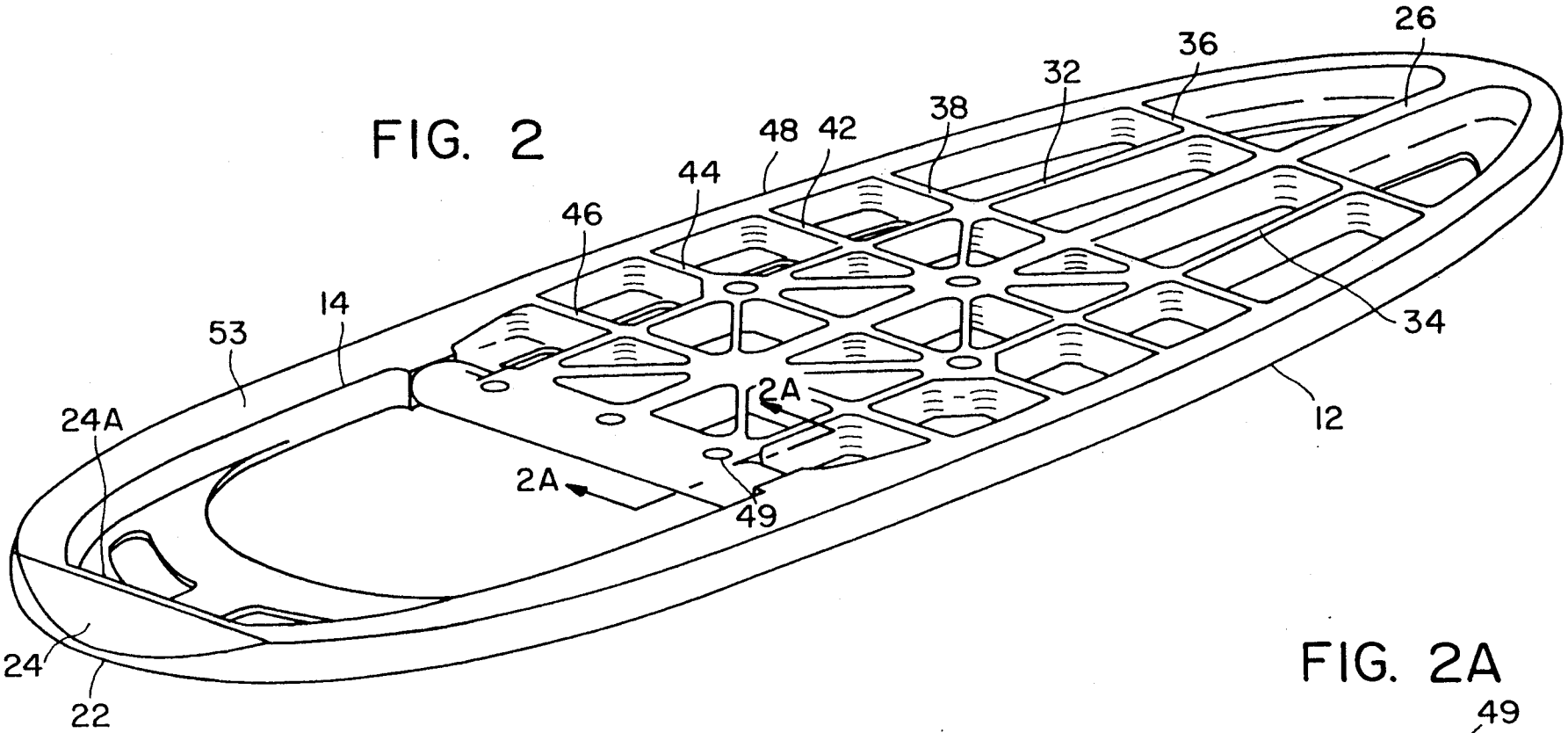
FIG. 2 is an isometric view of the underside of the embodiment shown in FIG. 1.

From FIG. 2 it will be seen that outer edge 48 forms an outer continuous flat surface along the periphery of platform 12.

Figure 2A:
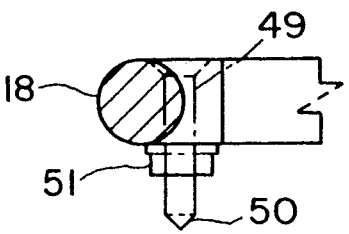
FIG. 2*a* is a section view taken along 2*a*—2*a* of FIG. 2.

From FIG. 2*a* it is seen that bolts 49 with points 50 extending beyond nut 51 for the binding can function as replaceable spikes or studs whose length can be varied by changing bolts 49 to suit the user.

Figure 3:
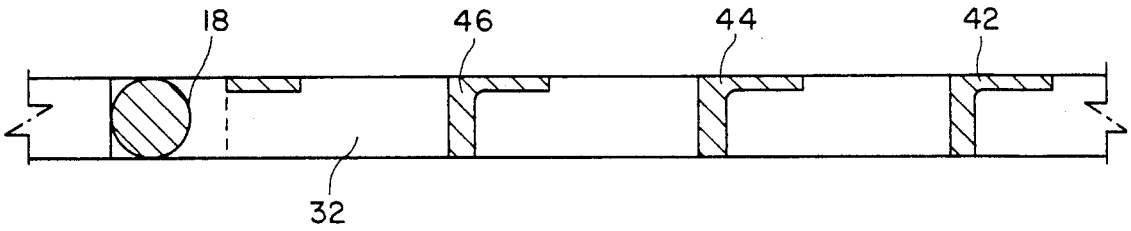
FIG. 3 is a section taken along 3—3 of FIG. 1.

As seen in FIG. 3, lateral ribs 42, 44, and 46 have an L-shaped cross section to provide additional strength without accompanying weight.

Additional studs (not shown), similar to bolts 49 may be installed through the snowshoe extending below the bottom of the snowshoe to provide additional traction. These would be similarly removable and replaceable.

The flat top construction enhances the snow shedding ability of the shoes with openings for the snow to flow through. The flat toe, that is, chamfer 24, allows for an additional vertical face 24*a* on the rear face of the toe which minimizes backsliding. The webfoot design using an integral molded membrane greatly improves flotation by increasing bearing area. The cross beam construction described permits the beams to double as deep treads.

Figure 5:
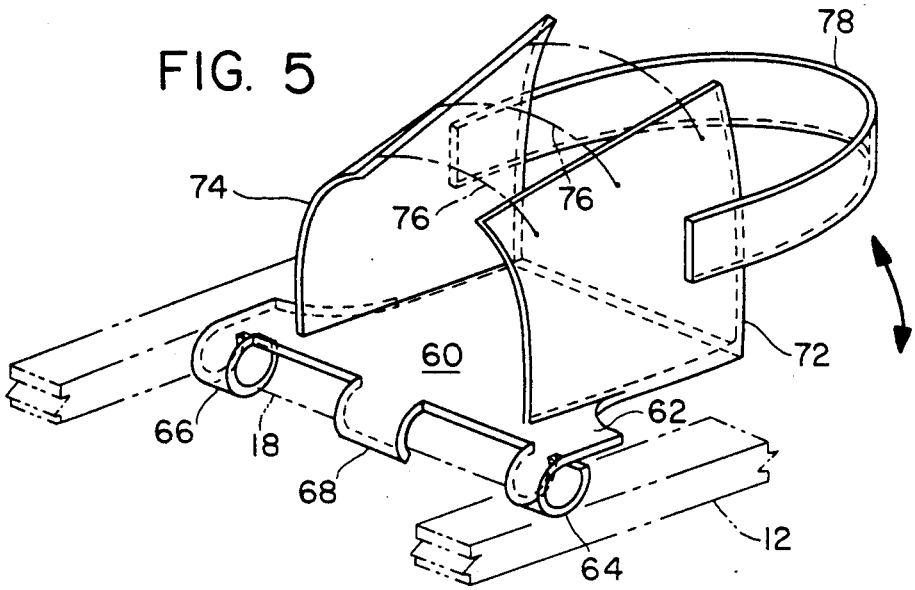
FIG. 5 is an isometric view of a binding mounted on the shoe shown in FIGS. 1–4.

Referring to FIG. 5, binding 60 is shown mounted on platform 12. Binding 60 consists of a base 62 with a pair of outer loops 64 and 66 wrapped around main cross brace 18, with a center loop 68 partially wrapped around brace 18. The purpose and geometry of loop 68 prevents rotation past 90 degrees to prevent front of shoe from impacting with shin, thus acting as a stopper. This construction permits binding 60 to swivel about brace 18.

It is understood that loops 64 and 66 act as the outer race of a bearing which is attached to cross brace 18 acting as the inner race of a bearing allowing minimum friction during rotation.

Attached to base 62 in any convenient fashion are a pair of side walls 72 and 74 with holes for straps or buckles 76 for lacing and affixing the binding to boot 16. A strap 78 surrounding the back of boot 16 helps to secure the latter. Strap 78 may be elastic or may be made of two parts connected by a suitable buckle. Side walls 72 and 74 may be made of a suitable flexible material such as neoprene. It will be noted that in the construction of binding 60 just described, lateral or side to side rotation of boot 16 is prevented by outside loops 64 and 66.

Figure 6:
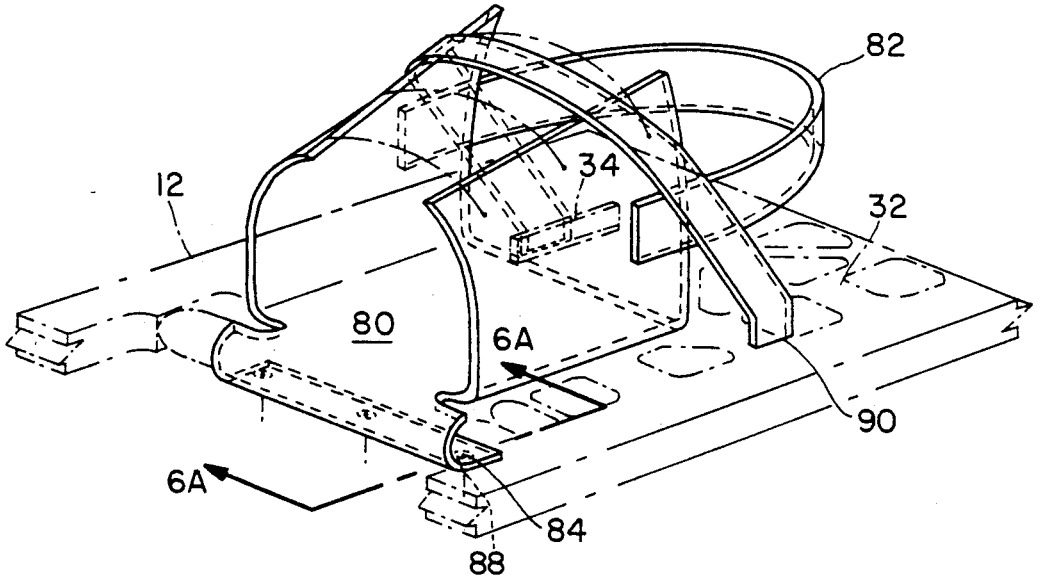
FIG. 6 is an isometric view of an alternative binding for use on the shoe shown in FIGS. 1–4.
Figure 6A:
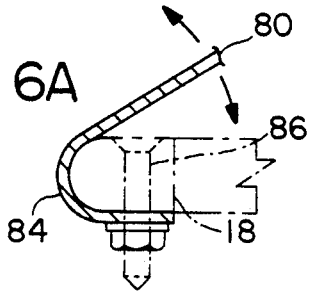
FIG. 6*a* is a section view taken along 6*a*—6*a* of FIG. 6 with the binding mounted on a snowshoe.

An alternate binding, which is readily removable and replaceable, is binding 80 shown in FIG. 6. Except for strap 82, similar to strap 78 in FIG. 5, binding 80 may be of single piece construction, made of a suitable flexible material such as neoprene. The front of binding 80 terminates in a flap 84 which is wrapped around main front cross brace 18, as also seen in FIG. 6*a*, and held in place by screws or bolts 86 passing through flap 84 and openings 88 in brace 18 as illustrated. This incorporates an adjustable strap 90 from rib 32 over the instep of boot 16 and affixed to rib 34 which is used to prevent the toe of the snow shoe from impacting shin of wearer. This strap may be further tightened so that the heel of the boot is forced against the top of the snowshoe. This feature prevents sideslipping of the heel and improves its ability to glissade.

An alternative to the bindings described is to use standard bindings currently available.

It has been found that snowshoes constructed according to the principles of this invention can be made smaller than existing shoes while being just as effective as a bigger shoe in supporting a person on the snow. For example, snowshoes designed according to this invention with overall dimensions of 8"×24" were tested and were shown to compare favorably to much larger snowshoes.

Because of the small size of the present snowshoes, and the controllable traction design and the heel restraint as well as flat surface 53, it is easier to glissade downhill in a controlled way. By glissading is meant sliding as opposed to walking.

Snowshoes constructed according to this invention are extremely lightweight thus minimizing fatigue. Going uphill the flat shoe and chamfered toe allows toeing-in thus a more direct path with minimal slippage. The chamfered toe aids in bringing the toe of the snowshoe up on top of the snow during forward motion. The studs allow for effective movement over hardpacked snow or ice. The heel restraint allows for controlled glissading.

Because of the material selected the snowshoes are molded and thus can be mass-produced at relatively low unit cost, about half the price of quality snowshoes now on the market while providing superior overall performance.

By careful optimization and balancing of the design features as well as efficient placement of structural components as hereinbefore described, a much stronger and more durable snowshoe is obtained.

While only certain preferred embodiments of this invention have been described it is understood that many variations are possible without departing from the principles of this invention as defined in the claims which follow.

What is claimed is:

1. A snowshoe for use with a boot having a toe portion comprising a platform of single piece, rigid construction having a binding mounted thereon, a. said platform comprising (i) a laterally extending main brace of circular cross section in outer regions and a circular forwardly facing section in a central region and forming the rear edge of a forward opening in said platform to accomodate the toe portion of said boot in said binding; (ii) a central rib extending rearwardly from said main brace to the rear of said platform along a central axis of said platform; and (iii) a plurality of intermediate, spaced laterally extending ribs located to the rear of said main brace, said laterally extending ribs being rectangular with a lip forming a L-shaped in cross section;

b. said binding having means pivoted on said main brace to support said boot to permit the toe of said boot to pass into said opening; and c. said binding being constructed completely of a flexible material having an extended portion wrapped around said main brace, bolt means for attaching said extended portion to said main brace, side walls extending up to enclose a portion of said boot for supporting the latter, said binding including strap means joining a pair of lateral ribs in said platform passing over the instep of said boot to prevent the shin of the wearer from being impacted by the toe of said snowshoe.

* * * * *